US005302404A

United States Patent [19]

Rissanen et al.

[11] Patent Number: 5,302,404

[45] Date of Patent: Apr. 12, 1994

[54] WALLPAPER

[75] Inventors: Pentti Rissanen, Kyröskoski; Antero Juopperi, Laitikkala; Veli-Matti Kaukonen, Kyröskoski, all of Finland

[73] Assignee: Oy Kyro Board & Paper Ltd., Kryoskoski, Finland

[21] Appl. No.: 976,359

[22] Filed: Nov. 18, 1992

[30] Foreign Application Priority Data

Nov. 18, 1991 [FI] Finland ..... 915425
Jan. 3, 1992 [FI] Finland ..... U 920026

[51] Int. Cl.[5] ..... B32B 9/00

[52] U.S. Cl. ..... 428/195; 428/95; 428/96; 428/204; 428/206; 428/207; 428/904.4

[58] Field of Search ..... 428/204, 206, 207, 904.4, 428/195, 95, 96

[56] References Cited

U.S. PATENT DOCUMENTS 2,901,377 8/1959 Bode ..... 428/904.4
3,574,656 6/1967 Sauntson et al. ..... 428/904.4
3,620,366 11/1969 Parkinson et al. ..... 428/904.4
3,887,748 6/1975 Swedenberg et al. ..... 428/907
4,031,281 6/1977 Keeling ..... 428/904.4
4,234,366 11/1980 Brewer et al. ..... 428/904.4
4,246,311 1/1981 Hirst ..... 428/195
4,293,458 10/1981 Gruenberger et al. ..... 428/904.4

FOREIGN PATENT DOCUMENTS 1771129 2/1976 Fed. Rep. of Germany .
2501684 11/1977 Fed. Rep. of Germany .
2201613 9/1988 United Kingdom .

*Primary Examiner*—Patrick J. Ryan
*Assistant Examiner*—Abraham Bahta
*Attorney, Agent, or Firm*—Pollock, Vande Sande & Priddy

[57] ABSTRACT

Wallpaper comprises a coating layer (2) containing latex binder and pigment on top of a base paper (1). The coating layer (2) contains a surface coating (PP) containing pigment and latex binder and its amount is at least 20 g/m$^2$ as dry matter. The total amount of the coating layer (2) is at least 30 g/m$^2$ as dry matter. The surface coating (PP) contains at least 30–70 parts of the latex binder per 100 parts of a water-insoluble pigment, whereof the amount of a water-insoluble inorganic mineral pigment is at least 40 wt-%. The wallpaper has essentially the same external properties as an ordinary PVC coated wallpaper and improved printing and embossing properties.

20 Claims, 1 Drawing Sheet

WALLPAPER

BACKGROUND OF THE INVENTION

The invention relates to a wallpaper comprising a coating layer containing latex binder and pigment on top of a base paper, said coating layer containing a surface coating containing pigment and latex binder, the amount of the surface coating being at least 20 g/m$^2$ as dry matter and the total amount of the coating layer being at least 30 g/m$^2$ as dry matter.

Polyvinyl chloride (PVC) is now used commonly as the coating of wallpapers. Said material has been used a coating mainly because of its protecting effect, such as good resistance to moisture, fat and mechanical stress.

However, the use of PVC in coatings involves some drawbacks. One of these drawbacks is the waste problem, which on one hand is due to the recycling problems of the used wallpaper and on the other hand to the wastes of the PVC coating process itself. Another problem is the devices and chemicals required by the process itself. In the coating the polyvinyl chloride is applied as a so-called plastisol on top of a web to be coated. This kind of plastisol is composed of a plasticizing medium that is usually an ester formed by an aromatic acid and an aliphatic long-chain alcohol, e.g. dioctyl phthalate, and of fine PVC particles suspended therein. In the process a uniform solid coating is created by heating the flowing plastisol applied on top of the web approximately above 150° C. For creating a decorative surface relief this kind of coating can be embossed by means of heat (so-called hot-embossing).

The aforementioned coating process requires special equipment and the use of organic aromatic chemicals causes problems of handling and waste disposal. One drawback associated with the finished product is that the PVC coating generates toxic substances when burning, for example hydrochloric acid, which decreases the fire safety of the wallpaper.

German Patent No. 2.501.684 shows a wallpaper coating where the coating contains a water-based styrene-butadiene latex as a binder as well as a pigment that can be insoluble starch or a mixture of calcium carbonate and calcium silicate. The amount of this type of coating on a base cardboard is usually 8–15 g/m$^2$. This publication mentions the drawbacks of a coating containing solely an inorganic pigment being that it is too glossy and rough after calendering and its gravure printing properties are insufficient, and further, that the wet attrition resistance is essentially lowered after it has been embossed.

British Application Publication No. 2201613 shows a wallpaper coating containing water-based acrylic or vinyl acetate based binder together with alumina hydrate serving as a fire retardant and optionally also with an inorganic coating pigment. In a typical coating composition shown by the examples there is 100 parts alumina hydrate per 100 parts binder. The possibility to use mineral fillers is mentioned only in the description.

German Auslegeschrift No. 1771129 shows a wallpaper coating containing water-based binder and water-glass and barium sulphate as inorganic components. The large amount of water-glass causes undesirable colour. The large amount of water-soluble water-glass does not render the wallpaper suitable to be printed with water-based printing inks.

SUMMARY OF THE INVENTION

The object of the invention is to carry a coated wallpaper into effect that can replace the PVC coated wallpapers and that at the same time has good matt surface, good printing ink absorption especially for water-based printing inks, good wet attrition resistance, smoothness and printability in gravure printing, and that can be well embossed cold. For achieving this object the wallpaper according to the invention is mainly characterized in that the coating layer contains a surface coating containing at least 30–70 parts of the latex binder per 100 parts of a water-insoluble pigment, whereof the amount of a water-insoluble inorganic mineral pigment is at least 40 wt-%. It has now been surprisingly discovered that by choosing a suitable ratio of latex binder and pigments, combined with a relatively high weight of coating per surface unit, it is possible to accomplish a wallpaper that externally does not differ from a wallpaper with a PVC coating, but is more safe to environment as regards the manufacture, the wastes produced by the manufacture, and the discharge after the use, being also more fire-safe.

According to one advantageous embodiment, the amount of the latex binder is 40–65 parts per 100 parts of the water-insoluble pigment.

According to one advantageous embodiment the proportion of the water-insoluble pigment and latex binder of the dry mass of the surface coating is over 95 wt-%, preferably over 98 wt-%.

According to one embodiment, the amount of the inorganic water-insoluble mineral pigment is over 95 wt-% of the total amount of the water-insoluble pigment.

According to an alternative embodiment of the invention, the water-insoluble pigment contains at least 5 parts of particles of a thermoplastic halogen-free polymer. The thermoplastic polymer particles help to create a good and stable hot-embossed pattern, but their presence does not deteriorate other properties of the wallpaper.

The optimum amount according to the above-mentioned embodiment is at least 10 parts, preferably over 20 parts of the thermoplastic halogen-free polymer particles. For good distribution properties of the coating over the base paper and for good printability, the amount of the polymer particles should be not more than 60 parts.

Still according to one embodiment, the coating layer can comprise a pre-coating layer containing latex binder and pigment and situated between the surface coating and the base paper. The pre-coating layer contains at least 8 parts, preferably 10–25 parts of the latex binder per 100 parts of the pigment. The pre-coating layer can consist of one single layer or of two pre-coating layers applied at different stages. The pre-coating layer helps to achieve a good smoothness before the surface coating, and its amount is at least 5 g/m$^2$, preferably 10–25 g/m$^2$.

According to one advantageous embodiment, the inorganic pigment of the surface coating contains both magnesium silicate (talc) and calcium carbonate. Said inorganic pigments help to obtain a good matt surface, and further, the use of calcium carbonate can decrease the wetting agent that is required by the dispersibility of talc, which would otherwise render the coating too hydrophilic.

The invention will be described more closely in the following with reference to the enclosed drawing and to some coating compositions for manufacturing a wallpaper according to the invention.

DETAILED DESCRIPTION OF THE INVENTION

In the following description the substances are always expressed as dry matter unless there is another indication. Whenever reference is made to "parts" the amount of parts is expressed in relation to 100 parts of a water-insoluble pigment.

Figure 1:
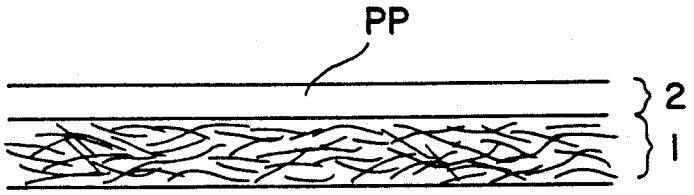
FIG. 1 shows a wallpaper according to the invention in cross-section.

FIG. 1 shows a coating layer 2 applied on top of a base paper 1. The coating layer has a surface coating PP that contains at least 30–70 parts latex binder per 100 parts water-insoluble pigment. The amount of the surface coating PP is at least 20 g/m$^2$ as dry matter.

The term "pigment" means in this context fine particles that are dispersed in the coating paste in addition to the latex binder and bound together by the binder in a finished coating.

Figure 2:
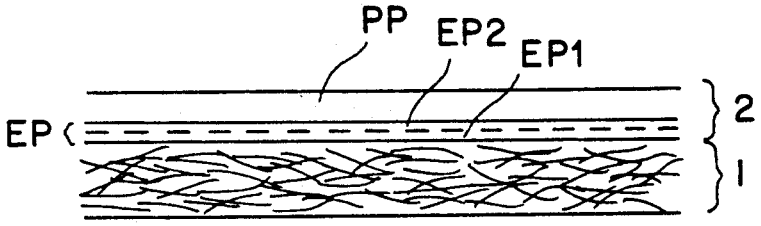
FIG. 2 shows another wallpaper according to the invention in cross-section.

The total amount of the coating layer is at least 30 g/m$^2$ as dry matter and most preferably it is within a range of 30 to 65 g/m$^2$. In this case it can be formed either of one coating layer 2 applied on top of the base paper 1 in one step. Nevertheless, the coating can, as shown by FIG. 2, be composed of the above-mentioned surface coating PP and a pre-coating layer EP applied on top of the base paper 1 before the surface coating. The amount of the surface coating PP can in this case vary in the range of 20 to 40 g/m$^2$ and the amount of the pre-coating layer EP is at least 5 g/m$^2$, preferably 10–25 g/m$^2$. The amount of latex binder in the pre-coating layer can be lower than in the surface coating PP and it can thus vary in the range of 10 to 25 parts per 100 parts of the pigment of the pre-coating layer.

The broken lines illustrate in FIG. 2 that the pre-coating layer EP can be composed also of two layers applied in different steps, the layers being designated by EP1 and EP2. The composition of these layers is the same as mentioned above and their amount is such as to get the aforementioned total amount of the pre-coating layer EP.

All water-based solvent-free latices can be used as the latex binder of the surface coating of the coating layer. Examples of these are the so-called homo- or copolymer latices generally used in wallpaper coatings, for example polyvinyl acetate homopolymer latex, polyvinyl acetate/acrylate copolymer latex, ethylene/vinyl acetate copolymer latex, styrene-acrylate copolymer latex, full acrylate latex and styrene-butadiene latex. Especially suitable for use in the invention are the polyvinyl acetate/acrylate copolymer, ethylene/vinyl acetate copolymer (PVAC and EVAC) and full acrylate latices, and less suitable for the purpose is the styrene-butadiene latex that tends to change colour in course of time.

As to the inorganic water-insoluble mineral pigments, all pigments commonly used in wallpaper coatings can be employed, such as bolus alba, calcium carbonate, calcium sulphate, i.e. gypsum, magnesium silicates, i.e. talc, aluminium silicates, titanium dioxide, barium sulphate, mica, or some mixtures of these. A mixture of magnesium silicate and calcium carbonate has proved to be a good mixture of inorganic mineral-based pigments, being particularly well applicable in the coating paste by means of which a wallpaper according to the invention is manufactured. The dispersibility of the talc, i.e. magnesium silicate into latex dispersion can thereby be improved by means of the calcium carbonate and special wetting agents increasing the dispersibility and rendering a finished coating too hydrophilic can be decreased. The calcium carbonate used in this case is preferably of the pulverized grade and not of the precipitated grade. The optimum ratio of the magnesium silicate and calcium carbonate is in the range of 3:1 to 1:3.

According to an alternative of the invention the water-insoluble pigment can contain also pigment particles of a thermoplastic halogen-free polymer besides the inorganic pigment particles. In order to make the wallpaper coating hot-embossable the proportion of these pigment particles should be at least 5 parts of the total 100 parts of the pigment. By the thermoplastic polymer particles it is possible to create a good and resistant hot-embossed pattern with properties no inferior to those of an ordinary PVC coated wallpaper. According to an advantageous embodiment, the proportion of the thermoplastic halogen-free polymer of the pigment particles is at least 10 parts, preferably over 20 parts. In order to still retain good distribution properties of the coating and good printability, the amount of the polymer is not more than 60 parts, the rest being inorganic pigment.

Figure 3:
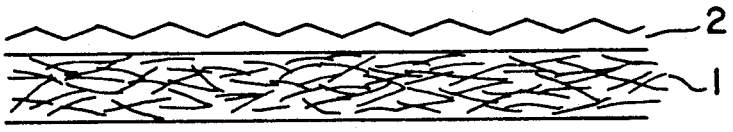
FIG. 3 shows a wallpaper where the coating has been embossed.

Particles consisting of a polymer with a melting point in a range 100° to 250° C. can be used as the thermoplastic halogen-free pigment particles. The thermoplastic particles can brought to a molten state by the heat of the embossing operation, the coating layer becomes more easily shapable and the particles create a stable surface pattern upon solidifying. FIG. 3 shows a wallpaper prepared in this way.

In the practice when preparing the coating paste the particles formed of the thermoplastic polymer can be mixed together with other constituents to form the paste whereby they are evenly distributed in the paste and in the finished coating. They can be used either as ready-to-use water dispersions or in powder form. These substances include polystyrene, polypropylene, polyethylene and polyester. It is also possible to use some blends thereof. The use of synthetic and non-synthetic waxes composed of a thermoplastic polymer is also possible. These kinds of wax dispersions include generally available hot-melt-dispersions where the particles form the pigment component of the thermoplastic halogen-free polymer in the coating. The aforementioned compounds can be replaced either wholly or partly by other thermoplastic compounds as well.

When the coating is prepared, the coating paste forming the surface coating PP can of course contain further fire retardants commonly used in wallpaper coatings, such as alumina hydrate, a swelling agent giving elasticity, hardeners as well as optical clarifiers, as well as other auxiliary substances, such as dispersing agents, defoaming agents, and viscosity adjusting agents, the total proportion of which the dry mass of the surface coating is usually below 5 wt-%, preferably below 2 wt-%. The amount of these substances is usually below 2 parts per 100 parts of the water-insoluble pigment.

Any paper having suitable surface properties can be used as the base paper 1. The grammage of the base paper can be for example 90–120 g/m². When pre-coating layers are used the surface to be coated can have more mechanical pulp than in the case of one single coating layer.

In the manufacture of the wallpaper according to the invention the coating layer can be applied by well-known coating methods, such as blade, air knife, rod, and roll coating methods. Further, it is possible to form the pre-coating layer EP as early as in the papermachine by means of one of the aforementioned methods and the surface coating PP can be formed by means of some off-machine method, for example air knife, blade, reverse roll, extrusion or silk screen method.

EXAMPLES

In the following some manufacturing formulas for the wallpaper according to the invention are presented. The amounts in the formulas are expressed as dry matter.

Formula 1. Normal Pre-coating (for blade coating)

| Purpose | Chemical composition | Parts |
|---|---|---|
| Pigment | Calcium carbonate | 100,0 |
| Dispersing agent | Salt of polyacrylic acid | 0,3 |
| Defoaming agent | Vegetable oil and fatty acid esters | 0,1 |
| Viscosity adjustment | Carboxymethylcellulose | 0,3 |
| Viscosity adjustment | Acrylic ester | 0,5 |
| Binder | PVAC-acrylate | 12,0 |
| Hardener | Melamine-formaldehyde resin | 0,4 |

dry matter content of the applied coating 58–67%
viscosity 600–1500 mPa · s/100 r/min/20° C.
amount of coating 5–25 g/m² dry Formula 2. Normal pre-coating (for air knife coating)

| Purpose | Chemical composition | Parts |
|---|---|---|
| Pigment 1 | Magnesium silicate | 30,0 |
| Pigment 2 | Calcium carbonate | 60,0 |
| Pigment 3 | Titanium dioxide | 10,0 |
| Dispersing agent | Ammonium salt of polycarboxylic acid | 0,3 |
| Defoaming agent | Vegetable oil and fatty acid esters | 0,1 |
| Viscosity adjustment | Acrylic ester | 0,3 |
| Binder | EVAC-dispersion | 20,0 |
| Hardener | Ammoniumzirconiumcarbonate | 0,6 |

dry matter content 55–65%
viscosity 50–300 mPa · s/100 r/min/20° C.
amount of coating 5–25 g/m² dry Formula 3. New surface coating replacing the PVC

| Purpose | Chemical composition | Parts |
|---|---|---|
| Pigment 1 | Magnesium silicate | 75,0 |
| Pigment 2 | Calcium carbonate | 25,0 |
| Dispersing agent | Salt of polyacrylic acid | 0,3 |
| Viscosity adjustment | Acrylic ester | 0,4 |
| Binder 1 | PVAC acrylate latex | 45,0 |
| Binder 2 | Polyvinyl alcohol | 5,0 |
| Hardener | Melamine-formaldehyde resin | 0,6 |

dry matter content 55–65%
viscosity 50–300 mPa · s/100 r/min/20° C.
amount of coating 20–50 g/m² dry Formula 4. New surface coating replacing the PVC (for air knife coating)

| Purpose | Chemical composition | Parts |
|---|---|---|
| Pigment 1 | Magnesium silicate | 67,5 |
| Pigment 2 | Calcium carbonate | 22,5 |
| Pigment 3 | Titanium dioxide | 10,0 |
| Dispersing agent | Sodium salt of polycarboxylic acid | 0,35 |
| Defoaming agent | Vegetable oil and fatty acid esters | 0,1 |
| Binder | EVAC-latex | 55,0 |

dry matter content 55–65%
viscosity 50–300 mPa · s/100 r/min/20° C.
amount of coating 20–50 g/m² dry Formula 5. New surface coating replacing the PVC (for blade, reverse roll, extrusion and silk screen methods)

| Purpose | Chemical composition | Parts |
|---|---|---|
| Pigment 1 | Magnesium silicate | 42,0 |
| Pigment 2 | Calcium carbonate | 42,0 |
| Pigment 3 | Titanium dioxide | 12,0 |
| Pigment 4 | Sodium aluminum silicate | 4,0 |
| Dispersing agent | Salt of polyacrylic acid | 0,4 |
| Defoaming agent | White oil based | 0,1 |
| Viscosity adjustment | Acrylic polymer dispersion | 0.6 |
| Viscosity adjustment | Carboxymethyl cellulose | 0,4 |
| Binder | Acrylic latex | 60,0 |

dry matter content 55–65%
viscosity 600–4000 mPa · s/100 r/min/20° C.
amount of coating 30–50 g/m² dry Formula 6. New hot-embossable surface coating replacing the PVC

| Purpose | Chemical composition | Parts |
|---|---|---|
| Pigment | Calcium carbonate | 75,0 |
| Polymer | Polyethylene | 25,0 |
| Dispersing agent | Salt of polyacrylic acid | 0,3 |
| Viscosity adjustment | Acrylic ester | 0,4 |
| Binder 1 | PVAC acrylate latex | 45,0 |
| Binder 2 | Polyvinyl alcohol | 5,0 |
| Hardener | Melamine-formaldehyde resin | 0,6 |

dry matter content 55–65%
viscosity 50–300 mPa · s/100 r/min/20° C.
amount of coating 20–50 g/m² dry Formula 7. New hot-embossable surface coating replacing the PVC (for air knife coating)

| Purpose | Chemical composition | Parts |
|---|---|---|
| Pigment 1 | Magnesium silicate | 30,0 |
| Pigment 2 | Calcium carbonate | 60,0 |
| Polymer | Polystyrene dispersion (Rhodopas) | 10,0 |
| Dispersing agent | Sodium salt of polycarboxylic acid | 0,35 |
| Defoaming agent | Vegetable oil and fatty acid esters | 0,1 |
| Binder | EVAC-latex | 55,0 |

dry matter content 55–65%
viscosity 50–300 mPa · s/100 r/min/20° C.
amount of coating 20–50 g/m² dry Formula 8. New hot-embossable surface coating replacing the PVC (for blade, reverse roll, extrusion and silk screen methods)

| Purpose | Chemical composition | Parts |
|---|---|---|
| Pigment 1 | Magnesium silicate | 40,0 |
| Pigment 2 | Calcium carbonate | 20,0 |
| Pigment 3 | Titanium dioxide | 10,0 |
| Polymer | Hot-melt dispersion (wax) | 30,0 |
| Dispersing agent | Salt of polyacrylic acid | 0,4 |
| Defoaming agent | White oil based | 0,1 |
| Viscosity adjustment | Acrylic polymer dispersion | 0,6 |
| Viscosity adjustment | Carboxymethyl cellulose | 0,4 |
| Binder | Acrylic latex | 60,0 |

dry matter content 55–65%
viscosity 600–4000 mPa · s/100 r/min/20° C.
amount of coating 30–50 g/m² dry The formulas 1 and 2 may also contain thermoplastic halogen-free pigments if the purpose is to make a hot-embossable coating.

In the table below are presented all conceivable pre-coating and surface coating combinations when a wallpaper according to the invention is manufactured using some of the formulas above.

TABLE

Examples of coating amounts run in various manners, the figures denote the grammage of the coating as dry, g/m²

Surface coatings (PP)

TABLE-continued

| Alternative | Pre-coating (EP) -blade -air knife (alternative) EP1 | EP2 | -air knife -blade -reverse roll -silk screen -extrusion (alternative) PP | total g/m² |
|---|---|---|---|---|
| A | — | — | 50 | 50 |
| B | 12 | — | 40 | 52 |
| C | 20 | — | 35 | 55 |
| D | 12 | 10 | 20 | 42 |
| E | 12 | 10 | 40 | 62 |

It has been found out that the wallpaper according to the invention has considerably better heat resistance compared with normal wallpapers provided with a PVC coating, for instance the decrease in visual lightness has been tenths of one per cent while that of the PVC coatings has been several per cent. Further, the wallpaper according to the invention burns less easily and creates less visible smoke and noxious substances than a PVC coated wallpaper on burning. In addition, the wallpaper according to the invention can be embossed also when cold, which is not possible for normal PVC coated wallpapers. The wallpaper has also better printing ink absorption, that is, it does not show pearls in printing to the same extent as the PVC coated wallpapers do. The impression is also better.

In the following, printing tests performed with the wallpaper according to the invention are described.

The base paper was a 98 g/m² two-ply paper, where the layer forming the coated surface was formed of chemical pulp and the other layer of mechanical pulp. The paper was coated with pre-coating layers EP1 (12 g/m²) and EP2 (10 g/m²) of the coating according to the formula 1. The coating was performed by blade coating. The surface coating with a grammage of 35 g/m² was applied on top of the pre-coating layer by air-knife coating using the coating composition according to the formula 4. The total amount of the coating applied over the base paper was thus 57 g/m².

A test run was performed by a gravure printing machine designed for the printing of wallpaper. A PVC-coated wallpaper and the above-mentioned wallpaper was printed in the machine. All six ink units having acrylic inks dissolved in toluene/methylethylketone solvents were used in the printing machine. The speed of the printing machine was 150 m/min and the drying temperature was 105° C.

First a wallpaper coated with the most commonly used PVC plastisol was printed in the printing machine, the amount of the base paper being 90 g/m² and the amount of the coating being 90 g/m². Thereafter the wallpaper according to the invention was printed with the same printing inks and in the same conditions. It was noteworthy that no excess adjustment was necessary for the printing machine when the PVC coated wallpaper was changed to the wallpaper according to the invention.

The wallpaper according to the invention attained clearly a brighter and more colourful impression than the PVC coated wallpaper. Also the transfer of the colour from the gravure printing cup onto the surface of the wallpaper was clearly better in the case of the wallpaper according to the invention compared with the PVC coated wallpaper.

In another test the printing was performed in a flexographic printing machine designed for wallpaper printing. The printed wallpapers were the same as in the previous test. The flexographic printing machine had six colour units and flexographic printing inks dissolved in alcohol/water were used. The speed of the printing machine was 150 m/min and the temperature was 110° C. The wallpaper according to the invention had a clearly brighter impression than the PVC-coated wallpaper.

The invention can be modified within the scope of the enclosed claims. It should be also noted that in the wallpaper according to the invention the surface coating PP may also contain any thin additional coating known in the art, applied after the coating operation in later processing steps of the wallpaper.

We claim:

1. A wallpaper comprising a coating layer containing latex binder and pigment positioned on top of a base paper, said coating layer having a surface coating (PP) containing pigment and latex binder, the amount of the surface coating (PP) being at least 20 g/m² as dry matter and the total amount of the coating layer being at least 30 g/m² as dry matter, wherein the surface coating (PP) contains at least 30–70 parts of the latex binder per 100 parts of a water-insoluble pigment, whereof the amount of a water-insoluble inorganic mineral pigment is at least 40 wt-%.

2. A wallpaper according to claim 1, wherein the amount of latex binder is 40–65 parts per 100 parts of the water insoluble pigment.

3. A wallpaper according to claim 1, wherein the proportion of the water-insoluble pigment and the latex binder of the dry mass of the surface coating is over 95 wt-%.

4. A wallpaper according to claim 1, wherein the amount of the inorganic water-insoluble mineral pigment is over 95 wt-% of the total amount of the water-insoluble pigment.

5. A wallpaper according to claim 1, wherein the water-insoluble pigment contains at least 5 parts of particles of a thermoplastic halogen-free polymer in the total amount of 100 parts of the water-insoluble pigment.

6. A wallpaper according to claim 5, wherein the amount of the thermoplastic halogen-free polymer particles is at least 10 parts in the total amount of 100 parts of the water-insoluble pigment.

7. A wallpaper according to claim 6, wherein the amount of the thermoplastic halogen-free polymer particles is no more than 60 parts.

8. A wallpaper according to claim 1, wherein the coating layer comprises a pre-coating layer (EP) containing latex binder and pigment and situated between the surface coating (PP) and the base paper, said pre-coating layer (EP) containing at least 8 parts of the latex binder per 100 parts of the pigment.

9. A wallpaper according to claim 8, wherein the amount of the pre-coating layer (EP) is at least 5 g/m².

10. A wallpaper according to claim 1, wherein the inorganic pigment of the surface coating (PP) contains both magnesium silicate and calcium carbonate.

11. A wallpaper according to claim 2, wherein the proportion of the water insoluble pigment and the latex binder of the dry mass of the surface coating is over 95 wt-%.

12. A wallpaper according to claim 1, wherein the proportion of the water insoluble pigment and the latex binder of the dry mass of the surface coating is over 98 wt-%.

13. A wallpaper according to claim 2, wherein the amount of the inorganic water-insoluble mineral pigment is over 95 wt-% of the total amount of the water-insoluble pigment.

14. A wallpaper according to claim 2, wherein the water-insoluble pigment contains at least 5 parts of particles of a thermoplastic halogen-free polymer in the total amount of 100 parts of the water-insoluble pigment.

15. A wallpaper according to claim 3, wherein the water-insoluble pigment contains at least 5 parts of particles of a thermoplastic halogen-free polymer in the total amount of 100 parts of the water-insoluble pigment.

16. A wallpaper according to claim 5, wherein the amount of the thermoplastic halogen-free polymer particles is at least 20 parts in the total amount of 100 parts of the water-insoluble pigment.

17. A wallpaper according to claim 1, wherein the coating layer comprises a pre-coating layer (EP) containing latex binder and pigment and simulated between the surface coating (PP) and the base paper, said pre-coating layer (EP) containing at least 10–25 parts of the latex binder per 100 parts of the pigment.

18. A wallpaper according to claim 7, wherein the coating layer comprises a pre-coating layer (EP) containing latex binder and pigment and situated between the surface coating (PP) and the base paper, said pre-coating layer (EP) containing at least 8 parts of the latex binder per 100 parts of the pigment.

19. A wallpaper according to claim 8, wherein the amount of the pre-coating layer (EP) is at least 10–25 $g/m^2$.

20. A wallpaper according to claim 9, wherein the inorganic pigment of the surface coating (PP) contains both magnesium silicate and calcium carbonate.

* * * * *